US006935381B2

(12) United States Patent
Debuf et al.

(10) Patent No.: US 6,935,381 B2
(45) Date of Patent: Aug. 30, 2005

(54) DEVICE FOR DRIVING ONE OR SEVERAL PILE CARRIERS FOR THE SELECTION OF ONE OR SEVERAL PILE YARNS

(75) Inventors: Geert Debuf, Drongen (BE); Koen Bruynoghe, De Pinte (BE); Peter Garnett, Morpeth-Northumberland (GB)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 10/400,929

(22) Filed: Mar. 28, 2003

(65) Prior Publication Data

US 2004/0108013 A1 Jun. 10, 2004

(30) Foreign Application Priority Data

Mar. 29, 2002 (BE) ..... 2002/0227

(51) Int. Cl.[7] ..... D03D 39/00

(52) U.S. Cl. ..... 139/2; 139/7 A; 139/7 R; 139/7 B; 139/116.5

(58) Field of Search ..... 139/2, 5, 6, 7 R, 139/7 A, 7 B, 116.5

(56) References Cited

U.S. PATENT DOCUMENTS 3,963,057 A * 6/1976 Dewhirst ..... 139/2
3,963,058 A * 6/1976 Dewhirst ..... 139/2
5,743,306 A * 4/1998 Stewart et al. ..... 139/7 A
6,289,938 B1 * 9/2001 Dewispelaere ..... 139/7 A
6,293,314 B1 * 9/2001 Dewispelaere ..... 139/2

FOREIGN PATENT DOCUMENTS

| | | | |
|---|---|---|---|
| EP | 0785301 | 7/1997 | |
| EP | 1029959 | 8/2000 | |
| EP | 1156146 | 11/2001 | |
| GB | 2189513 A * | 10/1987 | ..... D03D/39/08 |
| GB | 2189515 A * | 10/1987 | ..... D03D/39/08 |
| GB | 2231590 | 11/1990 | |
| GB | 2367076 | 3/2002 | |

* cited by examiner

*Primary Examiner*—John J. Calvert
*Assistant Examiner*—Robert H. Muromoto
(74) *Attorney, Agent, or Firm*—James Creighton Wray; Meera P. Narasimhan

(57) ABSTRACT

A device is provided for driving one or several pile carriers (2) for the selection of one or several pile yarns (15), comprising at least one drive motor (4) for driving a pile carrier (2), the pile carrier moving under the motor housing (7) of the drive motor and the motor shaft (5) of the drive motor (4) being provided with driving means (6) for directly driving the pile carrier (2), the pile carrier (2) being provided for performing a linear back and forth movement.

13 Claims, 4 Drawing Sheets

DEVICE FOR DRIVING ONE OR SEVERAL PILE CARRIERS FOR THE SELECTION OF ONE OR SEVERAL PILE YARNS

This application claims the benefit of Belgian Application No. 2002/0227 filed Mar. 29, 2002.

BACKGROUND OF THE INVENTION

The invention relates to a device for driving one or several pile carriers for the selection of one or several pile yarns. More particularly the invention relates to such a device comprising at least one drive motor for driving a pile carrier, the pile carrier moving under the motor housing and the motor shaft of the drive motor being provided with driving means for driving the pile carrier directly.

Up to this moment, similar devices for driving one or several pile carriers for the selection of one or several pile yarns, were mainly used with gripper axminster weaving machines.

In BE 1 010 005 a device is described indeed for guiding and moving pile carriers in a gripper axminster weaving machine. In this device, the pile carriers are brought from one position into the other by directly controlled linear motors. The selection movement remaining restricted to the displacement over that distance between two successive selection positions.

This device has the disadvantage that the linear motors require very exact linear guides in order to absorb the mutual attractive forces between windings conducting electric current and permanent magnets exiting magnetic fields. These linear guides and the linear motors are relatively expensive. Linear guides require a good lubrication and therefore careful maintenance is required.

In EP 1 029 959 a device is described for guiding and driving pile carriers, based on the use of classic motors with rotating armature. In these devices a drive motor with rotating armature is coupled to each pile carrier. This coupling always occurs, according to the figures represented, by means of an auxiliary driving means, such as a gear belt and a gear wheel, functioning as an intermediate wheel or simply a gear wheel as an intermediate wheel.

The disadvantage of this device is that it requires more transmission components with additional bearings, causing more wear and tear and therefore relatively much maintenance. Moreover these intermediate wheels will cause more clearance in the driving system, so that the precision of the activated positions is lost. Because of which the pile yarn is no longer positioned exactly above the rapier jaws. This is the cause of the fact that the rapier jaws fail to catch the yarn presented and will cause the stop-motion of the pile yarn to bring the weaving machine to a halt.

These drawbacks are remedied in EP 1 156 146, in which a device and a method are described, with which 12 or 24 yarns of different colors are found on a selector wheel and a motor being provided which is able to bring the selector wheel in different angular positions in order to present the color desired to the yarn conditioner, presenting the yarn to the rapier by rotating over an angle of 180°. The yarn conditioner is provided for serving different rapiers, for instance 8, by means of the selector wheel during the time available. In this manner the selector wheel will not have to wait till the rapiers return from the shed in order to present the pile yarns to the 8 rapiers for the next weaving cycle, but the selector wheel may start immediately after the yarn conditioners will simultaneously present all pile yarns to the rapiers by turning a 180°, by presenting the pile yarns one by one in the other holders for the next cycle.

The disadvantage of this method is, that such a selector wheel takes up more width of the weaving machine per selector. When the selector wheel may be kept smaller than the drive motor, the cross-section of the motor becomes the restricting factor for arranging the selectors side by side.

SUMMARY OF THE INVENTION

The objective of the invention is to provide for a device for driving one or several pile carriers for the selection of one or several pile yarns not having the disadvantages mentioned above.

At the same time, the objective of the invention is to provide for a device for driving one or several pile carriers for the selection of one or several pile yarns, so that a direct drive of the pile carriers is realized by their respective motors, without any auxiliary means interfering, while the clearance may be kept minimal, the device being provided as compact as possible and a limited width of the machine per pile carrier is required, so that sufficient pile carriers may be installed side by side.

These objectives are attained by providing for a device for driving one or several pile carriers for the selection of one or several pile yarns, comprising at least one drive motor for driving at least one pile carrier, said pile carrier moving in a plane situated under the motor housing of said drive motor, driving means being provided on the motor shaft of said drive motor for a direct drive of said pile carrier and the pile carrier being provided for performing a linear back and forth movement.

In a preferred embodiment of the device according to the invention, the pile carrier is provided for performing a linear back and forth movement.

Preferably, the driving means comprise a gearwheel having a radius exceeding the distance between the motor shaft and the lower point of the motor housing.

In a preferred embodiment of the device according to the invention, the motor housing is provided with a recess, such that the gearwheel driving the adjacent pile carrier partly extends in this recess.

This has the advantage that the length of the line of motors is limited in the longitudinal direction for a same number of motors or that more motors may be installed over the same length.

In a particular embodiment of the device according to the invention, the gearwheel directly engages a toothed rack provided on the pile carrier.

Preferably, the width of the gearwheel and the toothed rack being practically equal to the pitch of the pile carriers.

Moreover, the drive motors are preferably installed on a line according to the longitudinal direction of the pile carriers, each time stepped over a pitch in a direction perpendicular to the longitudinal direction of the pile carriers.

In a specific embodiment of the device according to the design a double-sided guide is provided between the bundle of pile yarns and the foremost drive motor of the line of drive motors, which is both supplying support and avoiding an upward movement of the pile carriers under the influence of the elastic retracting force of the pile yarn.

By providing such a double-sided guide also the tooth pressure may be absorbed and deflection caused by the tooth pressure is avoided.

Preferably, the distance between the double-sided guide and the foremost drive motor of the line of drive motors is such that the couple of forces caused when a pile yarn is pulled through a pile carrier is compensated by an antagonistic couple of forces caused between the gearwheel of the first drive motor in the line of drive motors and the double-sided guide.

In a particular embodiment of a device according to the invention, the pile carriers are provided with a guiding strip at the top extending above the upper face of the pile carriers and which has a length exceeding the stroke length.

Another disadvantage of the known device for guiding and moving the pile carriers in an rapier axminster weaving machine as treated in BE 1 010 005 is that the pile carriers are functioning in a very dusty environment, because of which the linear guides are subjected to pollution and the pile carriers may easily get stuck.

An additional objective consists in providing a device for driving one or several pile carriers for the selection of one or several pile yarns with one or several characteristics of the present invention but which may function in a dusty environment without really requiring much maintenance.

This objective is attained by providing for a device according to the present invention, in which the pile carriers are supported by at least three guide reeds.

In this manner, an open reed guide is obtained, having the advantage that the dust will fall down the spaces between the guide reeds and cooling air may be conducted to the motors.

In an alternative preferred embodiment of a device according to the invention, each pile carrier is supported by a guiding piece, which is attached to each corresponding drive motor.

This has the advantage that the connection between the drive motor and the guiding piece is fixed and will less depend on temperature and will be less sensitive to vibrations.

In a preferred embodiment of a device according to the invention, the device comprises one or several removable modules, per module two lines of drive motors being provided.

This present invention will now be further explained by means of the following detailed description of a preferred device for driving one or several pile carriers for the selection of one or several pile yarns according to the present invention. This is intended to be only an exemplifying description and to indicate further advantages and particulars of the present invention, and therefore on no account this may be considered being a restriction of the field of application of the invention or of the patent rights set forth in the claims.

BRIEF DESCRIPTION OF THE DRAWINGS

In this detailed description, reference is made by means of reference numbers to the attached drawings, in which.

DETAILED DESCRIPTION OF THE DRAWINGS

Figure 1:
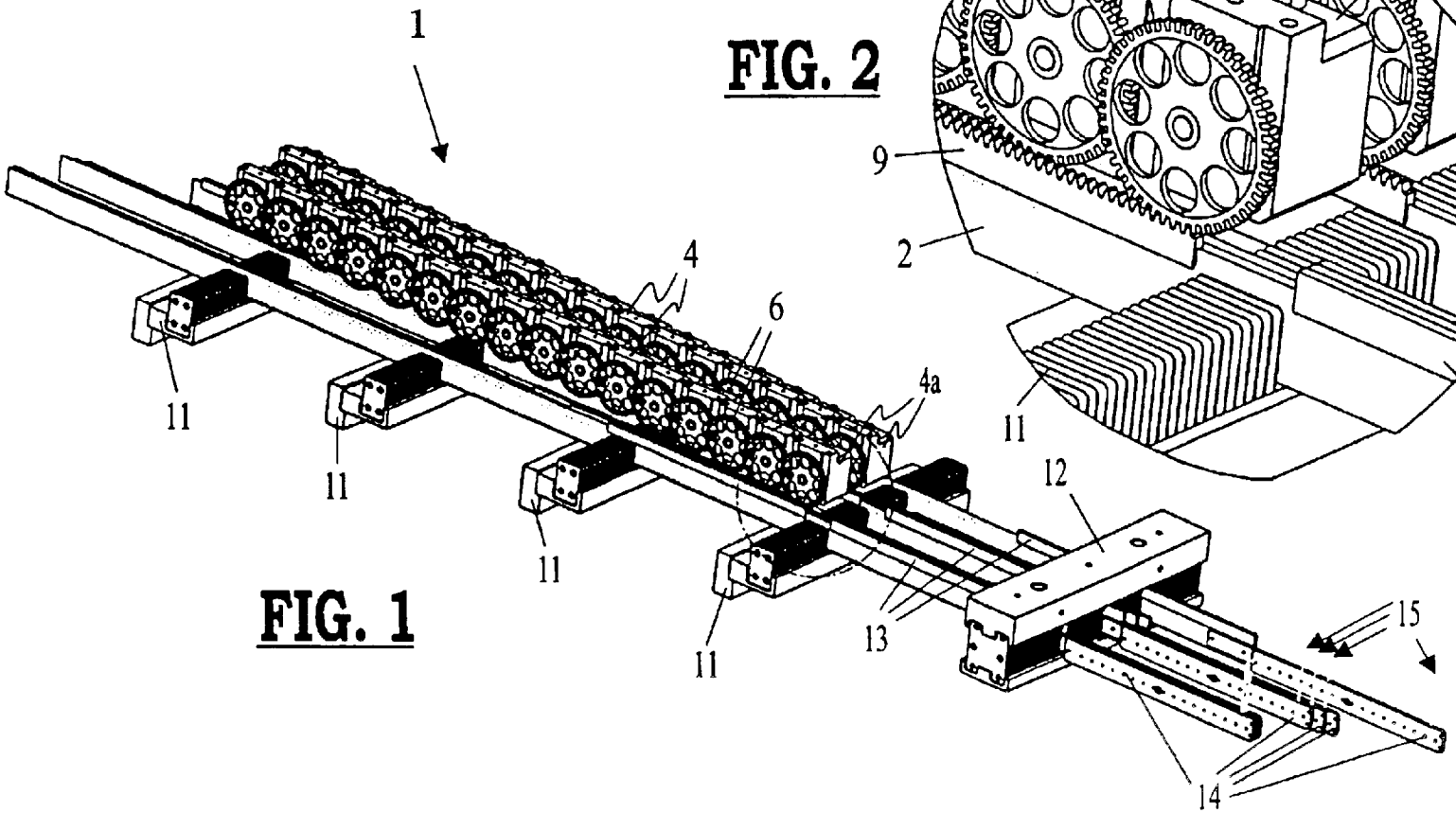
FIG. 1 is a perspective view of a device for driving one or several pile carriers for the selection of one or several pile yarns according to the invention.
Figure 3:
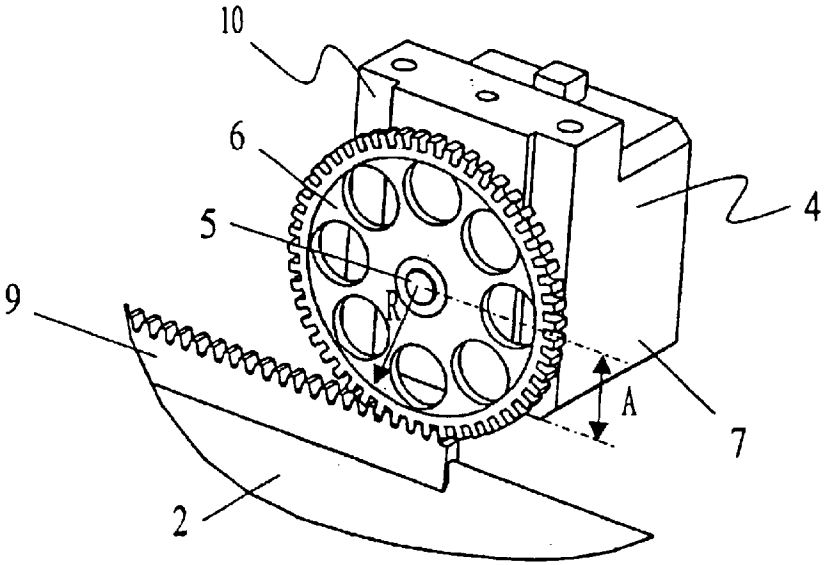
FIG. 3 is a detail of the part indicated within a circle in FIG. 4.
Figure 4:
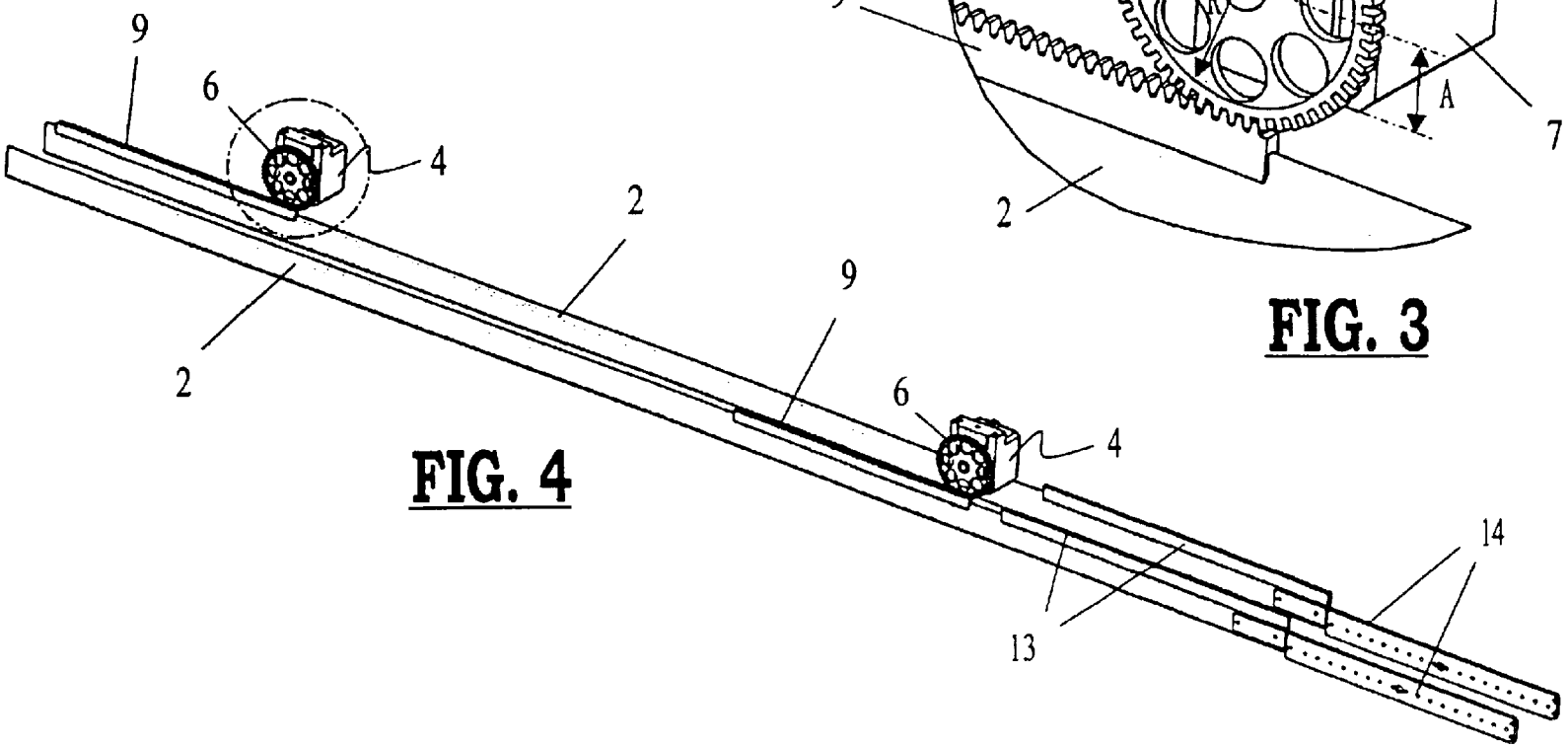
FIG. 4 is a perspective view of two pile carriers, each driven by a drive motor.

In a device (1) for driving one or several pile carriers (2) for the selection of one or several pile yarns (15) according to the invention, as is represented in FIG. 1, one drive motor (4), more precisely one rotative drive motor has been provided per pile carrier (2), as represented in the FIGS. 3 and 4. These drive motors (4) are suspended from a structure above the pile carriers (2). The pile carrier (2) being moving back and forth in a linear manner in a plane situated under the motor housing (7) of the drive motor (4). On the motor shaft (5) a gearwheel (6) has been installed, having a radius, which exceeds the distance (A) between the motor shaft and the lower point of the motor housing (7). This gearwheel (6) directly engages the toothed rack (9), made of synthetic material, which is attached to the pile carrier (2). The width of the gearwheel (6) and the toothed rack (9) is practically equal to the pitch of the pile carriers (2). Preferably, 16 pitches per length are bridged, per 2.54 cm (corresponding to 1 inch) 7 to 9 pitches being provided.

Figure 2:
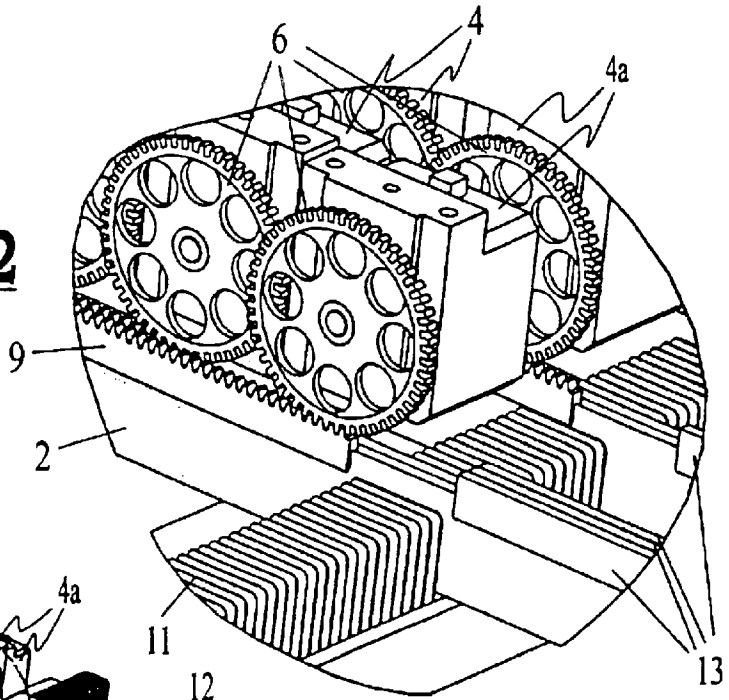
FIG. 2 is a detail of the part indicated within a circle in FIG. 1.
Figure 5:
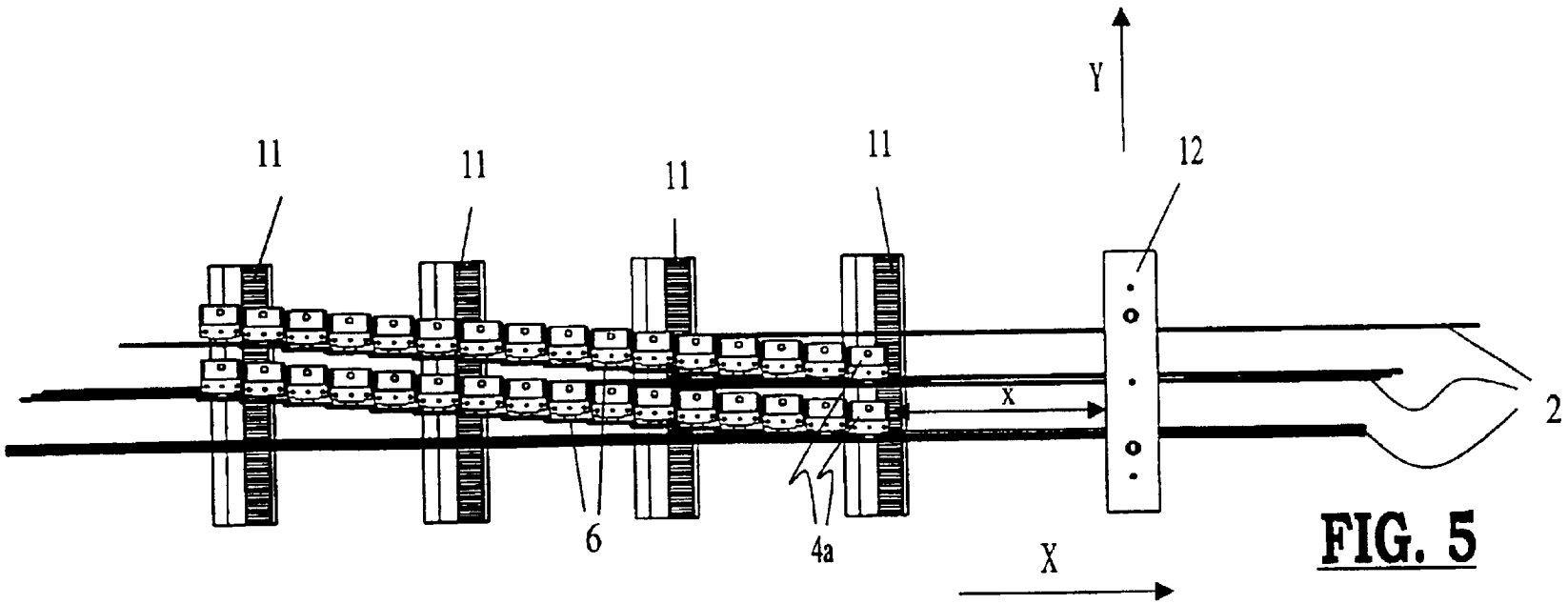
FIG. 5 is a top view of a device for driving one or several pile carriers for the selection of one or several pile yarns according to the invention.
Figure 6:
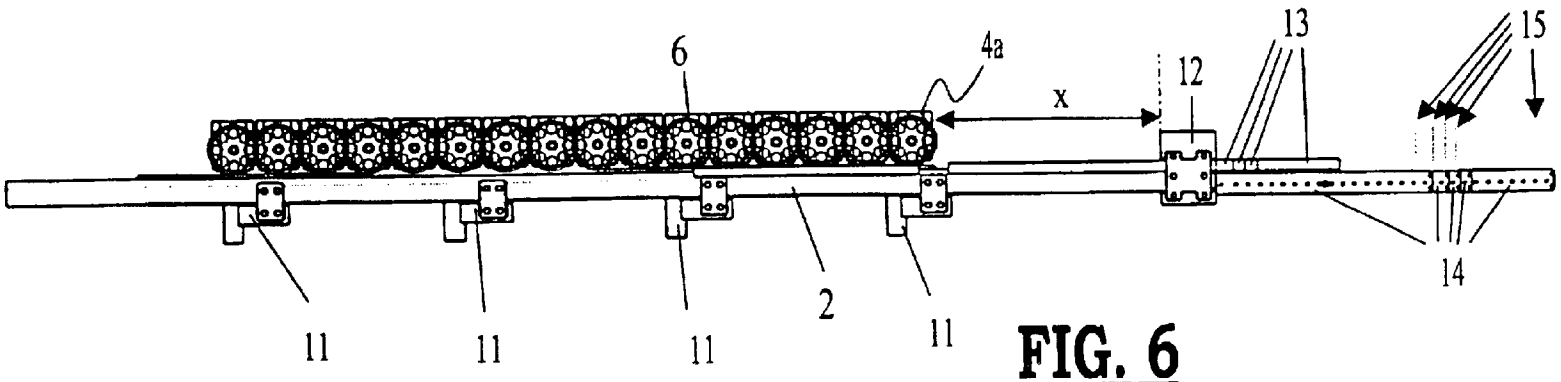
FIG. 6 is a side view of a device for driving one or several pile carriers for the selection of one or several pile yarns according to the invention.

The drive motors (4) are installed in one line according to the longitudinal directions (X) of the pile carriers (2), as represented in FIGS. 1, 5 and 6. These drive motors (4) have been staggered over a pitch in a direction (Y) at right angles to the longitudinal direction (X) of the pile carriers (2) as may be seen in FIG. 2. The gearwheels (6) being likewise staggered over one pitch.

As may be seen in FIGS. 1, 2, 5 and 6, the gearwheels (6) are overlapping each other in the longitudinal direction (X), because of which the length of a line of motors is limited in the longitudinal direction (X) or because of which more motors may be installed over the same length. For that purpose, the motor housing (7) is provided with a recess (10) in which a gearwheel (6) driving an adjacent pile carrier (2) partly extends.

Figure 7:
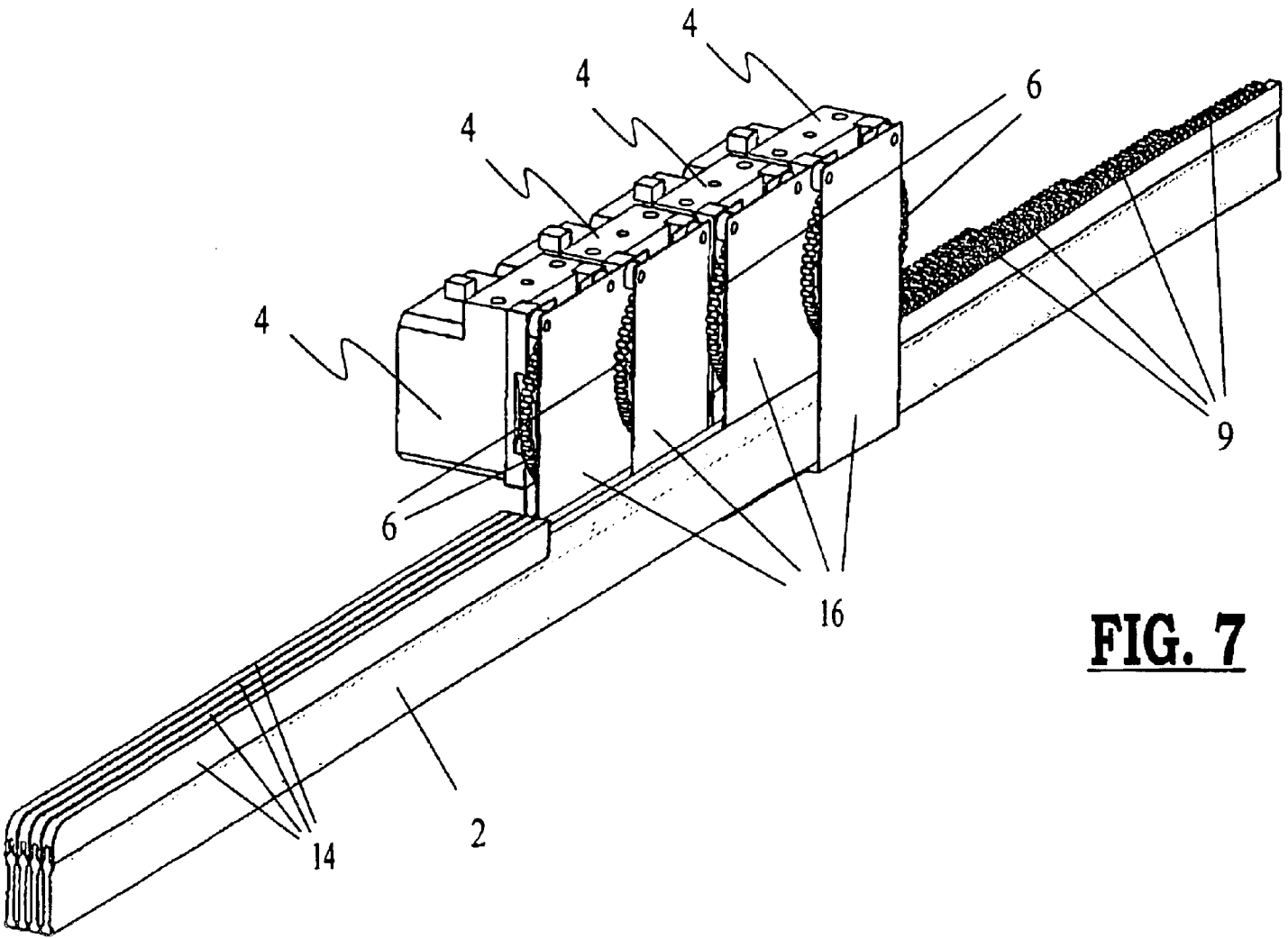
FIG. 7 is a perspective view of the pile carrier with a guiding piece attached to the drive motor.

The pile carriers (2) are supported by at least three and preferably by four guide reeds (11) as shown in FIGS. 1, 2, 5 and 6. In this manner an open reed guide is obtained, where the dust will fall down between the different guiding reeds (11) and cooling air may flow to the drive motors (4);

In an alternative embodiment for guiding the pile carriers (2), as represented in FIG. 7, guiding of the pile carrier (2) occurs by means of a toothed rack (9) through a guiding piece (16), which is attached to the drive motor (4) itself. for instance, attached to the motor housing (7) on the gearwheel (6) side and extends underneath the pile carrier (2), so that the connection between the drive motor (4) and the guiding piece (16) is fixed and further less dependent on the temperature and less sensitive to vibrations.

This alternative embodiment has the advantage with respect to the use of at least three guiding reeds (11) that no greater jamming will occur than the jamming between the gearwheel (6) and the toothed rack (9) caused by an expansion of the drive motor (4) and the gearwheel (6) due to the temperature. Another advantage is that in case of vibrations, the contact between the gearwheel (6) and the toothed rack (9) will remain constant in such an embodiment what, will not always be the case when using at least three guiding reeds (11).

Between the bundle of pile yarns (15) and the first drive motor **(4*a*) of a line of drive motors (4), as represented in FIGS. 1, 5 and 6, a double-sided guide (12) which is provided both to support and to avoid the upward movement of the pile carriers (2) due to the elastic retracting force of the pile yarn (15). The double-sided guide (12) is further used to absorb the tooth pressure and the deflection caused by the tooth forces. To that effect, there the pile carriers (2) are provided with an additional guiding strip (13) extending above the upper surface of the pile carriers (2) over a certain length, exceeding the stroke length, i.e. the maximum distance between the first and the last pile yarn (15) to be moved. The distance (x) between the double-sided guide (12) and the first drive motor (4***a*) of a line of drive motors (4) is such that the couple of forces, coming into being when a pile yarn (15) is pulled through the pile holder (14) as represented in FIG. 1, is absorbed by an antagonistic couple of forces between drive motor (4*a*)-gearwheel (6) and the double-sided guide (12).

Preferably, the pile carriers (2) are installed in a practically horizontal position, but they may be installed in a vertical or inclined position.

Two lines of drive motors (4) are provided in one module, being removably installed.

In order to allow the drive motors (4) to be installed in modules with this alternative embodiment for guiding the pile carriers (2) as represented in FIG. 7, the pile carriers (2) with the toothed racks (9) have to be shortened to a length where, in the most advanced position of the pile carrier, the gearwheel (6) is still just engaging the toothed rack (9). In this manner all pile carriers (2) connected to the same module, may be shifted over 1 time the pitch in the longitudinal direction, so that the gearwheels (6) will come clear from the toothed racks (9) and the drive motors (4) with the guiding pieces (16) connected to them may be moved upwards freely.

After the control mechanism of the weaving machine, for instance the Jacquard machine, will have finished to position the pile carriers, so that the pile yarns (15) desired will be presented to the rapiers, the rapiers will take the pile yarns (15) and pull them out over the pile length desired.

Before the blade now will cut through the pile yarns (15) at the length adjusted by the rapiers, all pile carriers (2) are moved simultaneously in a direction towards the weaver in order to bring the pile yarns (15) into a position assuring a better approach of the perpendicularity with respect to the backing fabric when positioning the pile yarns (15) in the backing fabric.

The advantage of such a method is that the rapier movement, which does not start in the direction of the pile yarn (15) supplied and pulled out, and therefore will adopt an inclined position when pulled out to pile length, will readopt un upright position, by the additional, controlled movement of the control mechanism, for instance, the Jacquard machine.

A similar device according to the invention is primarily applied in rapier axminster weaving machines, this is however no objection to use such a drive with other textile machines, provided with pile carriers.

The advantages of such a device for driving one or several pile carriers for the selection of one or several pile yarns are, that this arrangement and a direct drive allow for an exact positioning of the pile carriers above the line of rapier jaws. Taking up the pile yarn, once cut through, by the rapiers will be strongly improved.

The device hardly requires any maintenance, because the bearings are restricted to those in the motors. The supporting guide ensures an engagement free from clearance and the double-sided guide will ensure any unwanted vertical movement of the pile carriers to be avoided.

What is claimed is:

1. Device for driving one or several pile carriers (2) for the selection of one or several pile yarns (15), comprising at least one drive motor (4) for driving a pile carrier (2), the pile carrier moving under the motor housing (7) of the drive motor and the motor shaft (5) of the drive motor (4) being provided with driving means (6) for directly driving the pile carrier (2), characterized in that the pile carrier (2) is provided for performing a linear back and forth movement.

2. Device according to claim 1, characterized in that the pile carrier (2) is provided for performing a linear, horizontal back and forth movement.

3. Device according to claim 1 or 2, characterized in that the driving means comprise a gearwheel (6) having a radius (R) exceeding the distance (A) between the motor shaft (5) and the lower point of the motor housing (7).

4. Device according to anyone of the claims 1 through 3, characterized in that the motor housing (7) is provided with a recess (10), such that the gearwheel (6) driving an adjacent pile carrier (2) extend partly in this recess (10).

5. Device according to claim 3 or 4, characterized in that the gearwheel (6) directly engages a toothed rack (9) provided on a pile carrier (2).

6. Device according to claim 5, characterized in that the width of the gearwheel (6) and the toothed rack (9) is practically equal to the pitch of the pile carriers (2).

7. Device according to anyone of the claims 1 through 6, characterized in that the drive motors (4) are installed in a line according to the longitudinal direction (X) of the pile carriers (2), each time staggered over a pitch in a direction (Y) at right angles to the longitudinal direction (X) of the pile carriers (2).

8. Device according to anyone of the claims 1 through 7, characterized in that, between the bundle of pile yarns (15) and the foremost drive motor (4*a*) of the line of drive motors (4), a double-sided guide (12) has been provided which is both supporting and avoiding an upward movement of the pile carriers (2) caused by the elastic retracting force of the pile yarn (15).

9. Device according to claim 8, characterized in that the distance between the double-sided guide (12) and the foremost drive motor (4*a*) of the line of drive motors (4) is such, that the couple of forces coming into being when a pile yarn (15) is pulled through a pile carrier (14) is compensated by an antagonistic couple of forces coming into being between the gearwheel (6) on the first drive motor (4*a*) in the line of drive motors (4) and the double-sided guide (12).

10. Device according to anyone of the claims 1 through 9, characterized in that at the top of the pile carriers (2) a guiding strip (13) has been provided extending above the upper surface of the pile carriers (2) and having a length exceeding the stroke length.

11. Device according to anyone of the claims 1 through 10, characterized in that the pile carriers (2) are supported by at least three guiding reeds (11).

12. Device according to anyone of the claims 1 through 11, characterized in that each pile carrier (2) is supported by a guiding piece (16) attached to each corresponding drive motor (4).

13. Device according to anyone of the preceding claims, characterized in that the device comprises one or several removable modules, two lines of drive motors (4) having been provided per module.

* * * * *